US006751927B2

(12) United States Patent
Battisti

(10) Patent No.: US 6,751,927 B2
(45) Date of Patent: Jun. 22, 2004

(54) MACHINE FOR PRODUCING SO-CALLED STRIP PACKS

(75) Inventor: Antonio Battisti, Latina (IT)

(73) Assignee: Packservice S.r.l., Latina (IT)

( * ) Notice: Subject to any disclaimer, the term of this patent is extended or adjusted under 35 U.S.C. 154(b) by 1 day.

(21) Appl. No.: 10/349,229

(22) Filed: Jan. 22, 2003

(65) Prior Publication Data

US 2003/0136080 A1 Jul. 24, 2003

(30) Foreign Application Priority Data

Jan. 24, 2002 (IT) ..... BO2002A0034

(51) Int. Cl.[7] ..... B65B 47/00; B65B 61/26
(52) U.S. Cl. ..... 53/131.5; 53/559; 53/560
(58) Field of Search ..... 53/131.4, 131.5, 53/559, 560

(56) References Cited

U.S. PATENT DOCUMENTS 4,537,009 A * 8/1985 Kreamer ..... 53/560
6,167,684 B1 * 1/2001 Perrone ..... 53/560
6,679,031 B2 * 1/2004 Tampieri ..... 53/559

* cited by examiner

*Primary Examiner*—John Sipos
(74) *Attorney, Agent, or Firm*—William J. Sapone; Coleman Sudol Sapone, P.C.

(57) ABSTRACT

A machine for producing so-called strip packs includes: a station for feeding products to a packaging group, situated in cascade, which places and seals each of the products in relative heat-welded pockets, arranged on a continuous band; an operating station, situated in cascade with respect to the packaging group, equipped with: means for printing and/or applying codified data and/or information on each pocket; feeling detecting means for verifying the presence of corresponding products inside each pocket; pre-cutting groups for transversal precutting of the continuous band; cutting groups for longitudinal and transversal cutting of the continuous band; a compensation magazine, interposed between the packaging group and the operating station, and aimed at allowing, at least partial, accumulation of the continuous band. The continuous band is moved stepwise.

18 Claims, 6 Drawing Sheets

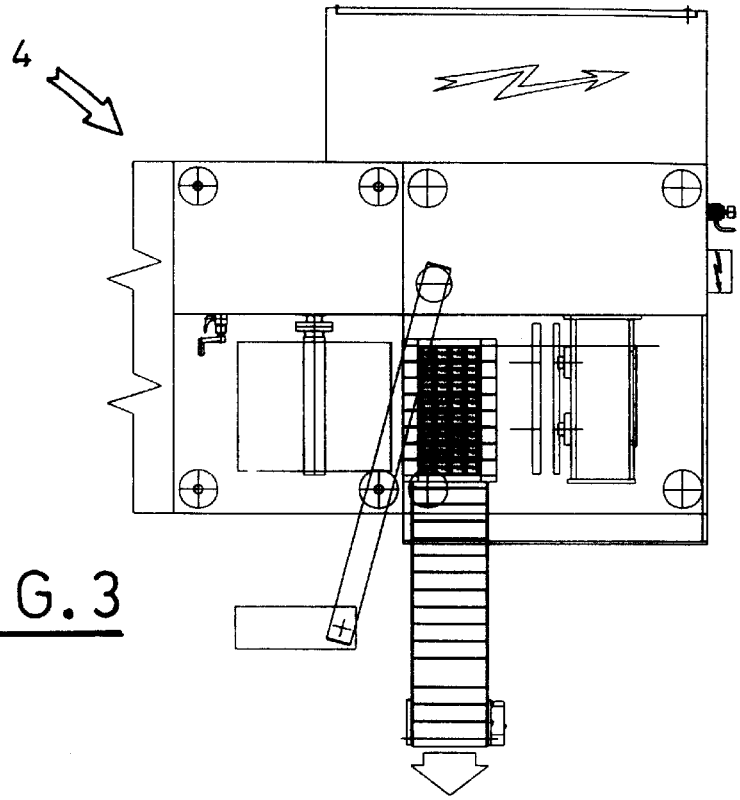
FIG. 3
FIG. 4
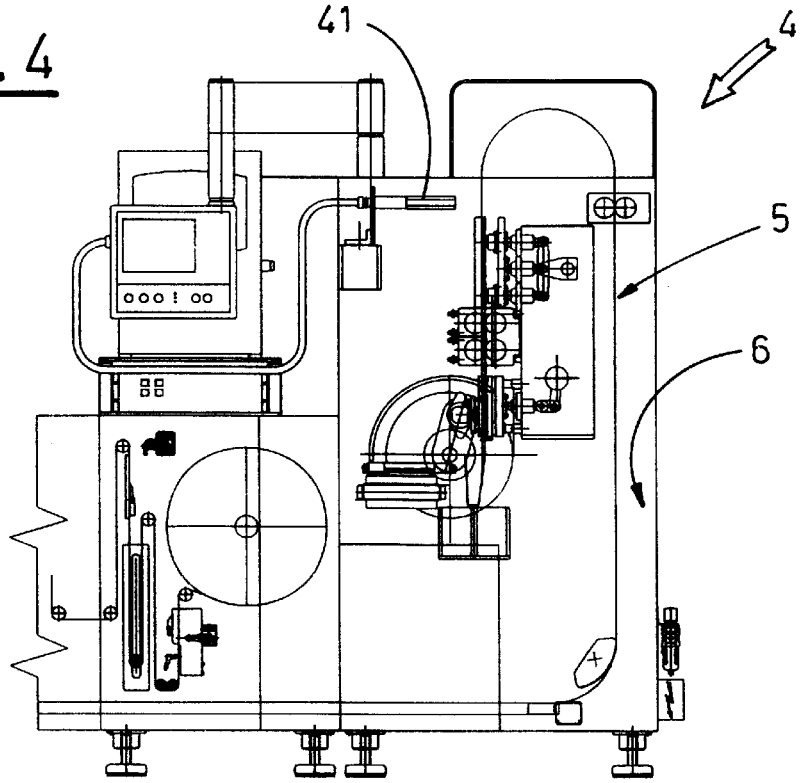

70
79a
79a 73g
73e
73c
73a 70
79a 73f
73d
73b

MACHINE FOR PRODUCING SO-CALLED STRIP PACKS

FIELD OF THE INVENTION

The present invention relates to automatic packaging of products, in particular, tablets, pills, capsules and the like.

In particular, the present invention proposes a machine for packaging the products into so-called "strip" packs of predetermined dimensions.

BACKGROUND OF THE INVENTION

Packaging in strips, unlike packaging in bottles, allows each product to be sealed hermetically, giving information about the product contained therein, printed and/or reported as a code on the relative package (for instance, packaging and expiry dates, composition of the product, dosage and use mode, etc.).

This package is particularly indicated for effervescent products, very sensitive to moisture, and for pharmaceutical products in general.

The strip packs are obtained from two sheets or bands of heat-weldable material, which are overlapped, thus touching each other, to define a plurality of pockets, suitably spaced apart and containing each one a single product.

The pockets are suitably heat-welded along the peripheral edges, so as to seal them hermetically.

In the region corresponding to the heat-welded areas included between adjacent pockets of the same longitudinal row, or of an adjacent row, pre-cuttings are made for defining pre-breaking lines which facilitate the detachment of a single pocket from the package.

According to the needs, the strip packs can be formed by only one pocket, containing the respective product, or by a plurality of pockets, generally arranged on one or more longitudinal files.

Known machines for packaging products in strip packs extend substantially vertically and, in most cases, are operated according to a continuous mode.

In the upper part of these machines, there is a feeding station which, in a way widely known to those skilled in the art, feeds products to a packaging station situated below in cascade, where the products are introduced and sealed in the respective pockets.

The packaging station includes a pair of upper counter-rotating rolls, which have horizontal and parallel axes, touch each other along a common generatrix, act together on two bands of heat-weldable material unwinding from respective bobbins, which are arranged facing each other and situated on both sides with respect to the rolls.

Each upper roll has a series of radial recesses made on its outer surface, which are regularly spaced apart both axially and angularly.

During synchronous movement of the rolls, the radial recesses of one roll face the radial seats of the adjacent roll, so as to define corresponding cavities, which receives the products released by the feeding station.

The products just released are placed between the two bands and into the cavities, so that they are wrapped by the bands of the upper rolls, to define corresponding containing pockets which are heat-welded near the peripheral edges thereof, thus obtaining hermetic and sealed packs.

The peripheral edges of the seats of each upper roll, in particular of the portions of the outer surface included between adjacent seats, are heated by relative groups of heating resistors, suitably distributed, whose temperature is constantly detected by a suitably positioned thermal probe.

Therefore, a continuous band of heat-welded pockets is obtained at the outlet of the pair of upper counter-rotating rolls.

The packaging station includes, in cascade with respect to the upper rolls and in a symmetrical position with respect thereto, a pair of lower counter-rotating rolls, which have horizontal and parallel axes and touch each other along a common generatrix. The lower rollers pull the continuous band, moving away from the packaging station.

A further operating station is situated downstream of the packaging station, i.e. downstream of the pair of lower rolls, which executes continuously an operation routine including, as follows: ink jet printing (or printing by equivalent systems) on each pocket; applying a code by die stamping punches; verify, by suitable feeler pin, of the presence of products inside each sealed pocket; pre-cutting, crosswise with respect to the forward movement direction of the band of heat-welded pockets, obtained by pre-cutting groups; longitudinal cutting of each longitudinal row by first cutting groups; crosswise cutting of each longitudinal row by second cutting groups.

The so obtained strip packs, formed by a predetermined number of pockets, are moved by chute conveyors, which, due to gravity, can space them in not particularly uniform way and, then send them to belt conveyors, which are situated nearby and generally arranged at 90° with respect to the feeding direction of the feeding station.

The worst disadvantage of these packaging machines is undoubtedly the necessity to use an additional machine, placed in cascade with respect to the described one, which allows feeding of a packaging machine capable of introducing so obtained strip packs into boxes, generally of cardboard.

This is substantially caused by the fact that the packs leaving the operating groups, suitably subjected to the steps of printing, feeling, code-applying, pre-cutting and cutting, are delivered to the conveyor belt by the chute conveyors in non-controlled configurations, which are undoubtedly not suitable to feed directly a packaging machine.

Another drawback derives from the remarkable vertical extension, i.e. in height, of the machines of the prior art, which does not allow the operator to see correctly the critical areas, like the upper rolls inlet area, as far as the products correct feeding is concerned, as well as the best position of the entering bands.

Conventionally, the above disadvantage is outweighed by mirror systems, which however allow an indirect visual control only, not particularly reliable and rather tiring for the operator.

It is also to be pointed out that the known machines work substantially with a continuous operation mode, which requires particularly sophisticated and expensive apparatuses for printing, verifying, code applying, pre-cutting and cutting, necessitating frequent and accurate maintenance and being affected by recurrent breakdowns.

SUMMARY OF THE INVENTION

The object of the present invention is to avoid the above mentioned drawbacks by proposing a machine, which supplies, in outlet, the so-called strip packs in a controlled configuration, allowing the feeding of any packaging machine.

Another object of the present invention is to propose a machine having reduced vertical extension, which allows any operator to visually control directly the machine critical areas, specially the areas of the working group inlet and outlet.

A further object of the present invention is to propose a machine equipped with simpler and more reliable operating means, which require particularly streamlined and rapid maintenance operation, and which are affected by to breakdowns with lower probability with respect to known machines.

A still further object of the present invention is to propose a machine obtained by a simple, extremely functional and reliable technical solution, which delivers the strip packs at the outlet arranged angularly with respect to the packaging group.

The above mentioned objects are obtained, in accordance with the contents of the claims, by means of a A machine for producing so-called strip packs, the machine including:

- a station for feeding products to a packaging group, situated in cascade, which places and seals each of said products in relative heat-welded pockets, arranged on a continuous band forming corresponding longitudinal and transversal rows of said pockets;
- an operating station, situated in cascade with respect to said packaging group, aimed at supplying, at the outlet, a plurality of strip packs of predetermined longitudinal and transversal dimensions, said operating station being equipped with: means for printing and/or applying codified data and/or information on each pocket of said continuous band;
- feeling detecting means for verifying the presence of corresponding products inside each pocket of said continuous band;
- pre-cutting groups for transversal precutting of said continuous band in portions included between adjacent transversal files;
- cutting groups, a first cutting group and a second cutting group, respectively for longitudinal and transversal cutting of said continuous band in portions included between adjacent longitudinal and transversal rows; means for pulling the continuous band;
- a compensation magazine interposed between said packaging group and said operating station, for accumulating, at least partially and upstream of said operating station, said continuous band, so as to allows a variable configuration thereof;
- with said continuous band being moved stepwise and in step relation with the intermittent and synchronous operating of said, first means, second means and pulling means, said feeling detecting means, said precutting groups and first cutting group and second cutting group, working in said operating station downstream of said packaging group.

BRIEF DESCRIPTION OF THE DRAWINGS

The characteristic features of the present invention will be pointed out in the following description of some preferred, but not only embodiments, with reference to the enclosed drawings, in which:

FIG. 3 shows a schematic top view of a final station of the machine characterized by a second so-called 90° outgoing configuration of the strip packs;

FIG. 4 is a schematic, enlarged, lateral view of the final station shown in FIG. 3;

DESCRIPTION OF THE PREFERRED EMBODIMENTS

Figure 1:
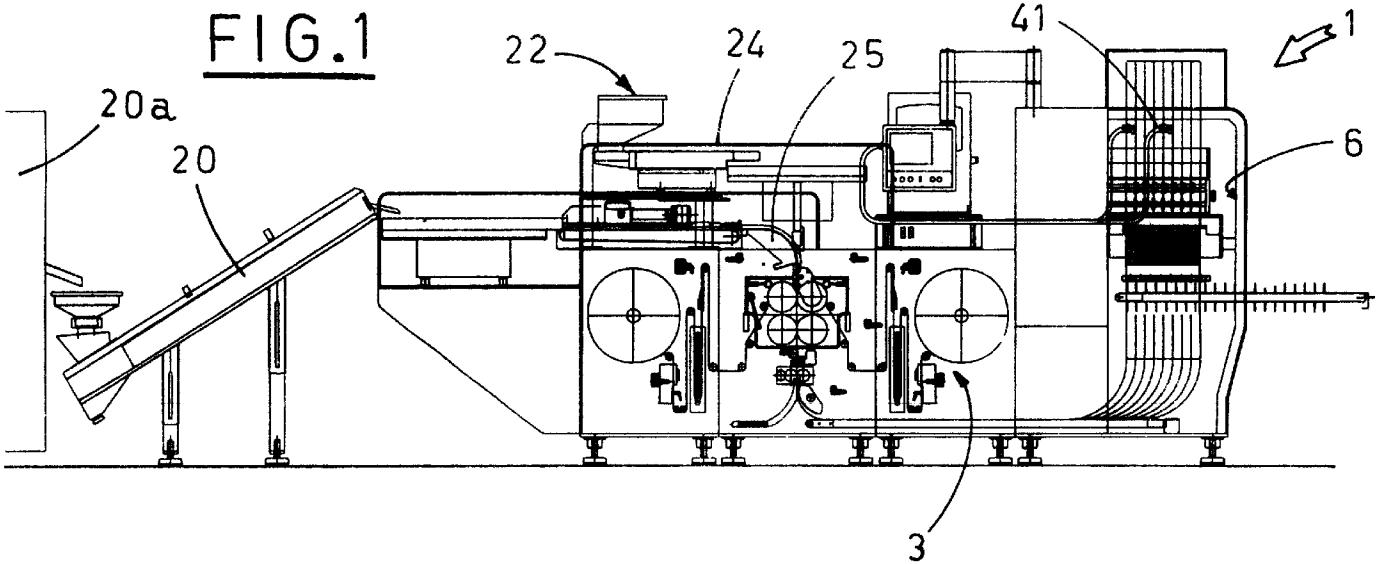
FIGS. 1, 2 show schematically corresponding lateral and top view of the proposed machine characterized by a first so-called in line outgoing configuration of the strip packs.

With reference to the above drawings, the reference numeral 1 indicates the proposed machine for obtaining the so-called strip packs, substantially including a station 2 for feeding products, in particular tablets, pills, capsules, e.g. effervescent, to a packaging group 3, situated in cascade.

The packaging group places each product in a pocket 5*a* and seals the latter by heat-welding, in a way widely known to those skilled in the art.

Consequently, at the outlet of the packaging group 3, a continuous band 5 of heat-welded pockets 5*a* is formed. The pockets 5*a* are uniformly distributed and define corresponding, longitudinal and transversal, rows.

Figure 2:
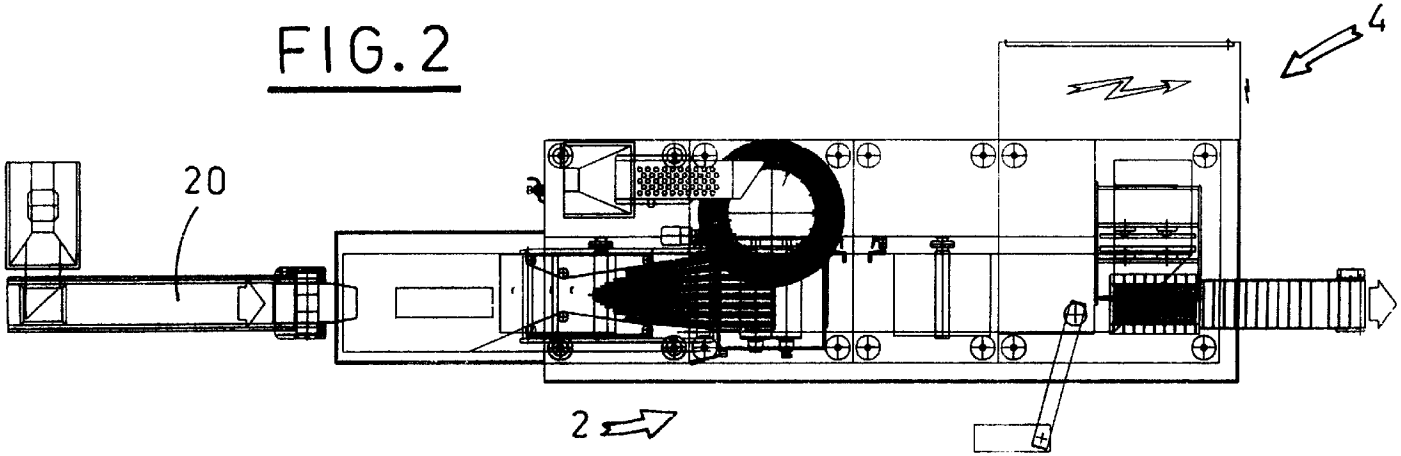

With reference to FIGS. 1 and 2, the feeding station 2 can include, as an example, two separate sections working in parallel, respectively for feeding effervescent tablets and for feeding pharmaceutical products.

The section for feeding effervescent tablets includes a container 20*a*, which feeds a conveying belt 20, substantially inclined upwards, which conveys the tablets to selecting means sending the tablets into the channels, slightly inclined downwards and designed to feed the packaging group 3.

The section for feeding pharmaceutical products includes in this case, a hopper 22, situated near the selecting means 24, which feeds pharmaceutical products into the channels 25, e.g. by means of a vibrating tray.

According to known configurations, the packaging station 3 includes a pair of upper counter-rotating rolls, which have horizontal and parallel axes, and touch each other along a common generatrix. The upper rollers act together on two bands of heat-weldable material unwinding from respective bobbins, which are arranged, facing each other, on both sides with respect to the rolls.

As anticipated, each upper roll has a plurality of radial recesses made on its outer surface, which are regularly spaced apart both axially and angularly. The, recesses face, during synchronous movement of each roll, the radial recesses of the adjacent roll, so as to define corresponding cavities, into which the products released by the feeding station are placed.

After that the released products are placed into the cavities, they are wrapped by the bands of the upper rolls, to define corresponding containing pockets 5*a*.

The latter are hermetical sealed by heat-welding the two bands in the region corresponding to the outer surface of the rolls, which are suitably knurled, included between adjacent recesses, near the peripheral edges thereof.

Advantageously, the peripheral edges of the recesses of each upper roll are heated by two groups of heating resistors, suitably arranged, one of which is destined for the principal operation, i.e. in nominal conditions, while the other one is destined for the emergency situations.

The temperature of each upper roll is constantly measured by a pair of suitably positioned thermal probes, one of which is destined for the principal operation, i.e. in nominal conditions, while the other one is destined for the emergency situations.

Consequently, in case of breakdown of the group of primary resistors and/or primary thermal probe, it is possible to activate the emergency group of resistors and/or the emergency thermal probe with a simple and rapid operation, without extending too much the down-time of the machine.

Each upper roll includes, in the regions corresponding to its extremities, a respective pair of rings, whose outer surface is smooth and whose diameters are slightly bigger than the diameter of the knurled portion, in which the recesses are made.

The rings of each upper roll are kept permanently in contact with the corresponding rings of the adjacent roll due to the presence of a packet of disk springs.

This way, it is possible to determine a selected clearance between the upper counter-rotating rolls and to impose a selected forming pressure, in the region corresponding to the knurled portions, on the bands during the heat-welding step.

Two load cells, one for each side, are advantageously interposed between the two upper rolls, to signal if the two upper rolls are subjected to even centesimal displacement, e.g. caused by small fragments which occur to be situated therebetween.

In this happens, the load cells unload automatically sending immediately a signal about the anomaly, thus preventing piercing and/or faults in the welded areas on the pockets side.

The packaging station 3 includes, situated in cascade with respect to the upper counter-rotating rolls and in axis therewith, a pair of lower counter-rotating rolls, which have parallel axes, touch each other along a common generatrix. The lower rollers pull the continuous band 5 far from the packaging station 3.

According to well known techniques, the packaging group 3, with particular reference to the pairs of counter-rotating rolls, upper and lower, is operated with a continuous operation mode.

A further operating station 4 is situated in cascade to the packaging station 3 to supply at the outlet a plurality of strip packs having predetermined longitudinal and transversal size.

The further operating station 4 is equipped, in known way, with: first means 41 for ink-jet printing (or printing by other equivalent systems) on each heat-welded pocket 5*a*; second means, e.g. for dry stamping, to apply a coded data and/or information between the adjacent heat-welded pockets; feeler detecting means for verifying the presence of corresponding products inside each sealed pocket 5*a*; pre-cutting groups for making transversal precutting in the continuous band 5 in the portions included between adjacent transversal rows; cutting means, first cutting means 42 and second cutting means 44, respectively for longitudinal and transversal cutting of the continuous band 5 in the portions included between adjacent longitudinal and transversal rows; driving means 43 for moving forward the continuous band 5.

Figure 5:
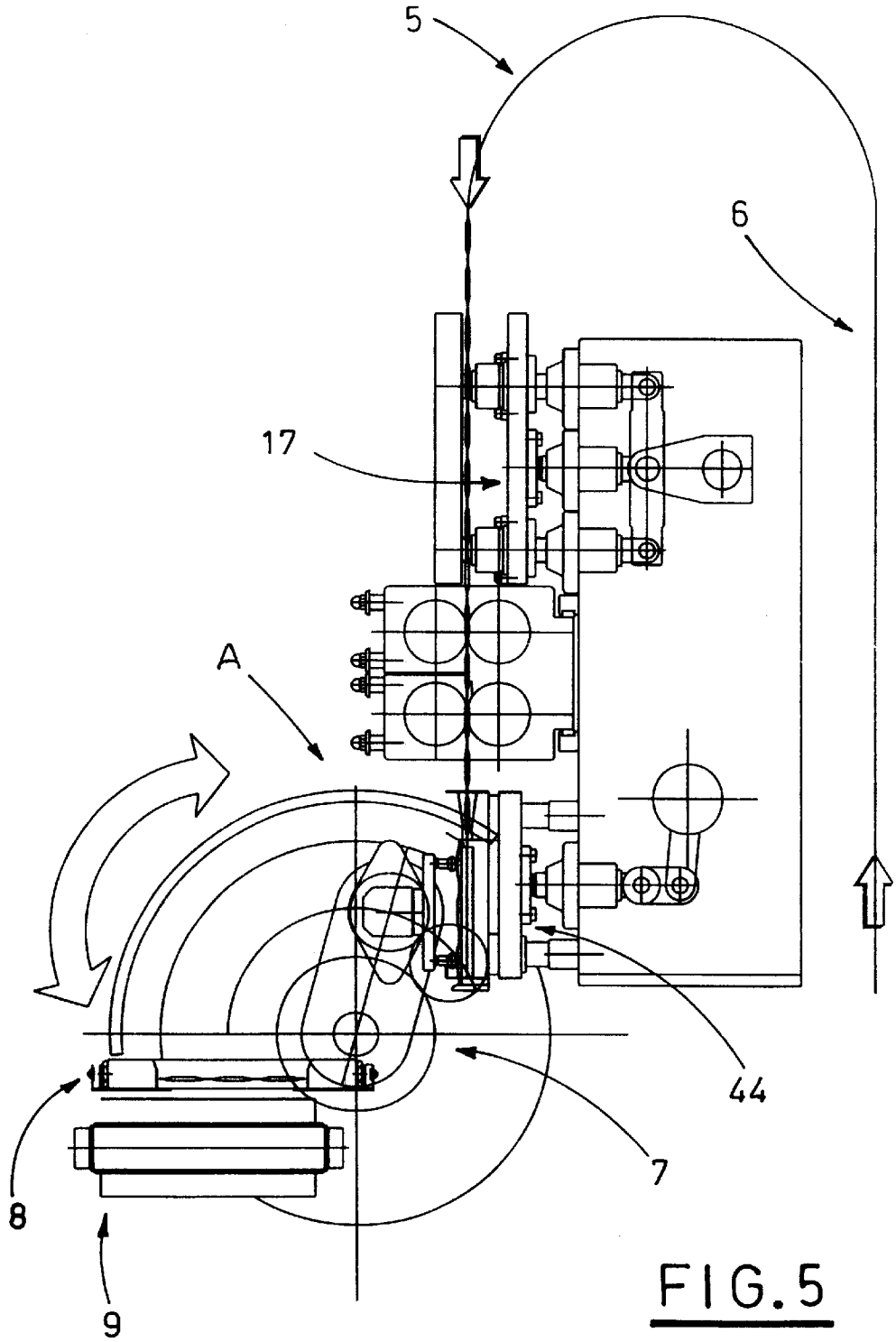
FIGS. 5, 6 show schematic and particularly enlarged, corresponding lateral and front views of the final station shown in FIG. 4.
Figure 6:
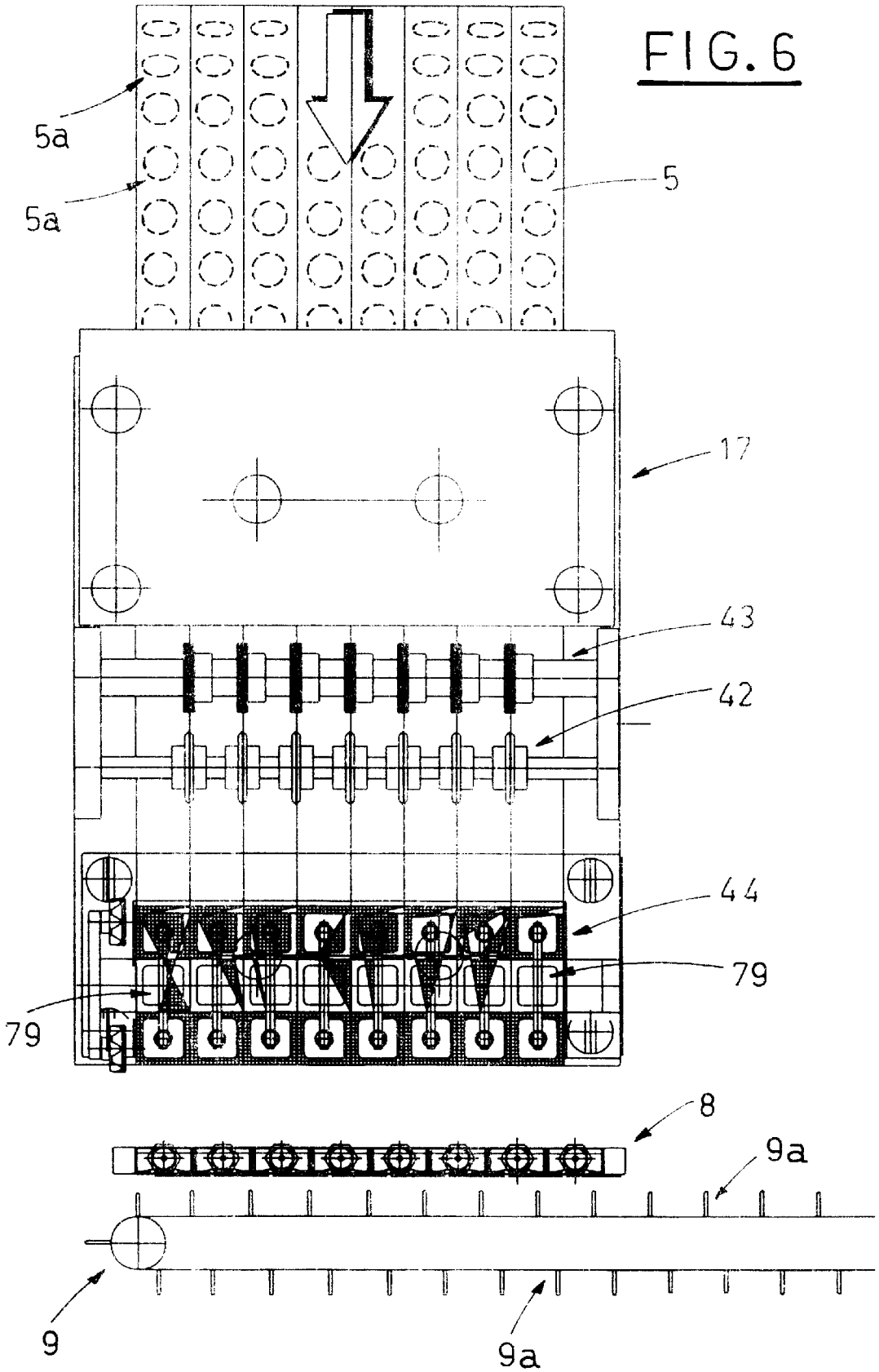

With reference to FIGS. 5 and 6, according to a preferred, but not unique operative configuration, a working group 17 is situated near the inlet of the further operating station 4, for carrying out printing, cutting and transversal pre-cutting operations.

Advantageously, the driving means 43 in the operating station 4 move stepwise the continuous band 5 in step relation with the intermittent and synchronous operating of the above-mentioned means, first 41 and second, feeling means, pre-breaking groups and cutting groups, first 42 and second 44, working in said operating station.

A compensation magazine 6, situated between the packaging group 3 and the operating station 4, allows to accumulate, upstream of the operating station 4, the continuous band 5, and allows smooth passage from the continuous working cycle of the feeding station 2 and of the packaging group 3, to an intermittent working cycle, i.e. stepwise, of the operating station 4.

The feeding station 2 and the packaging group 3 are situated in a first section of the machine, characterized by a continuous operation mode, while the operating station 4 and the compensation magazine 6, connected thereto, are situated in a second section of the machine, characterized by a stepwise operation mode.

The above sections of the machine, extending substantially in vertical, are preferably situated one beside another, so as to reduce considerably the total dimensions of the proposed machine 1.

Transferring means 7, situated in cascade to the operating station 4 and operated in step relation therewith, pick up the strip packs leaving the operating station 4 in substantially vertical configurations and release them onto a waiting line 8 in substantially horizontal configurations, regularly spaced out by a predetermined distance with respect to the pick up configuration.

Then, the waiting line 8 releases the strip packs, in a differentiated way and in predetermined configurations, into corresponding receiving seats 9*a* made in the conveyor means 9, extending below, parallel to the waiting line 8, e.g. in said second section of the machine.

The release by the waiting line 8 to the conveyor means 9 occurs in step relation with the moving step of the latter, so as to allow feeding of a packaging machine (FIG. 6).

The way, in which the waiting line 8 releases the strip packs into the corresponding seats 9*a* of the conveyor means 9, in step relation with the moving of the latter, is not a subject of the present invention.

The conveyor means 9, with the associated waiting line 8, are positioned angularly with respect to the outlet direction of the continuous band 5 coming out from the packaging group 3, i.e. they are positioned angularly with respect to the feeding band 20 of the feeding station 2.

In particular, in relation to the machine lay-out, the conveyor means 9 extend longitudinally (configuration in line; FIGS. 1, 2), or crosswise (configuration at 90°, FIGS. 3, 4) with respect to the feeding station 2, that is with respect to the corresponding conveying belt 20.

This is made possible by the presence of the compensation magazine 6, in which the continuous band 5 leaving the packaging group 3 can change its inlet configuration while entering the operating station 4 (FIGS. 1, 4).

The transferring means 7 include a plurality of gripping means 79, situated one beside another and in reciprocal alignment, operated by a guide shaft 70 sliding axially, substantially parallel to the waiting line 8; and the control means, which are aimed at changing the distance between adjacent gripping means 79 during their movement step, so as to allow the strip packs to be released onto the waiting line 8, in a regularly spaced apart configuration.

Figure 5A:
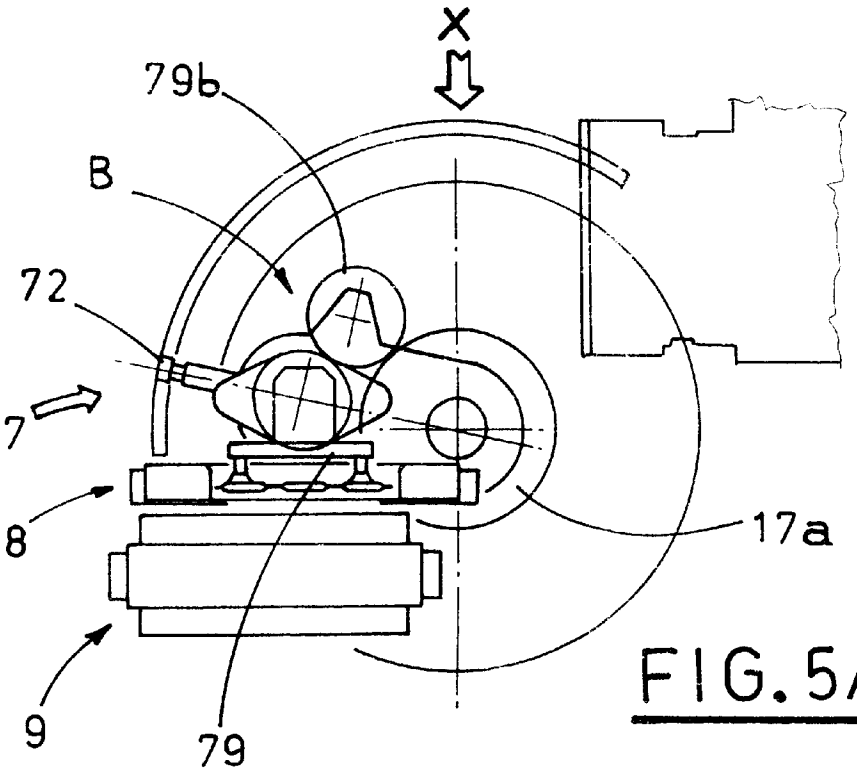
FIG. 5*a* shows, in the same view as FIG. 4, a particular mechanism set to a different operation position.

In step relation with the operating station 4, the gripping means 79 are moved from a pick up position A, in which they pick up the strip packs leaving the operating station in substantially vertical configurations, to a release position B, in which they release the strip packs onto the waiting line 8, in substantially horizontal configurations and regularly spaced apart with respect to the pick up position A by a predetermined distance (FIGS. 5, 5*a*).

Figure 8:
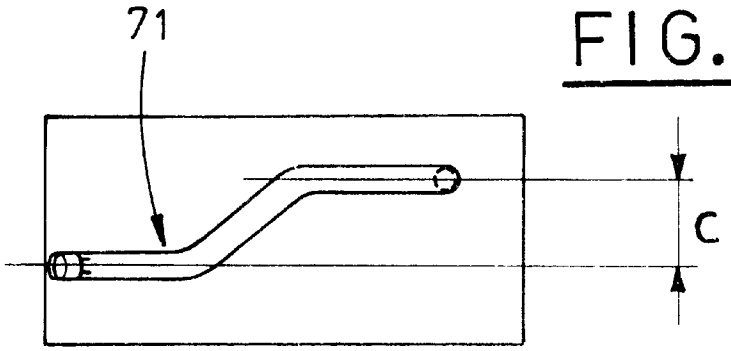
FIG. 8 shows a schematic view of a constructive particular seen according to the arrow X indicated in FIG. 5*a;*
Figures 9A, 9B, 10A, 10B:
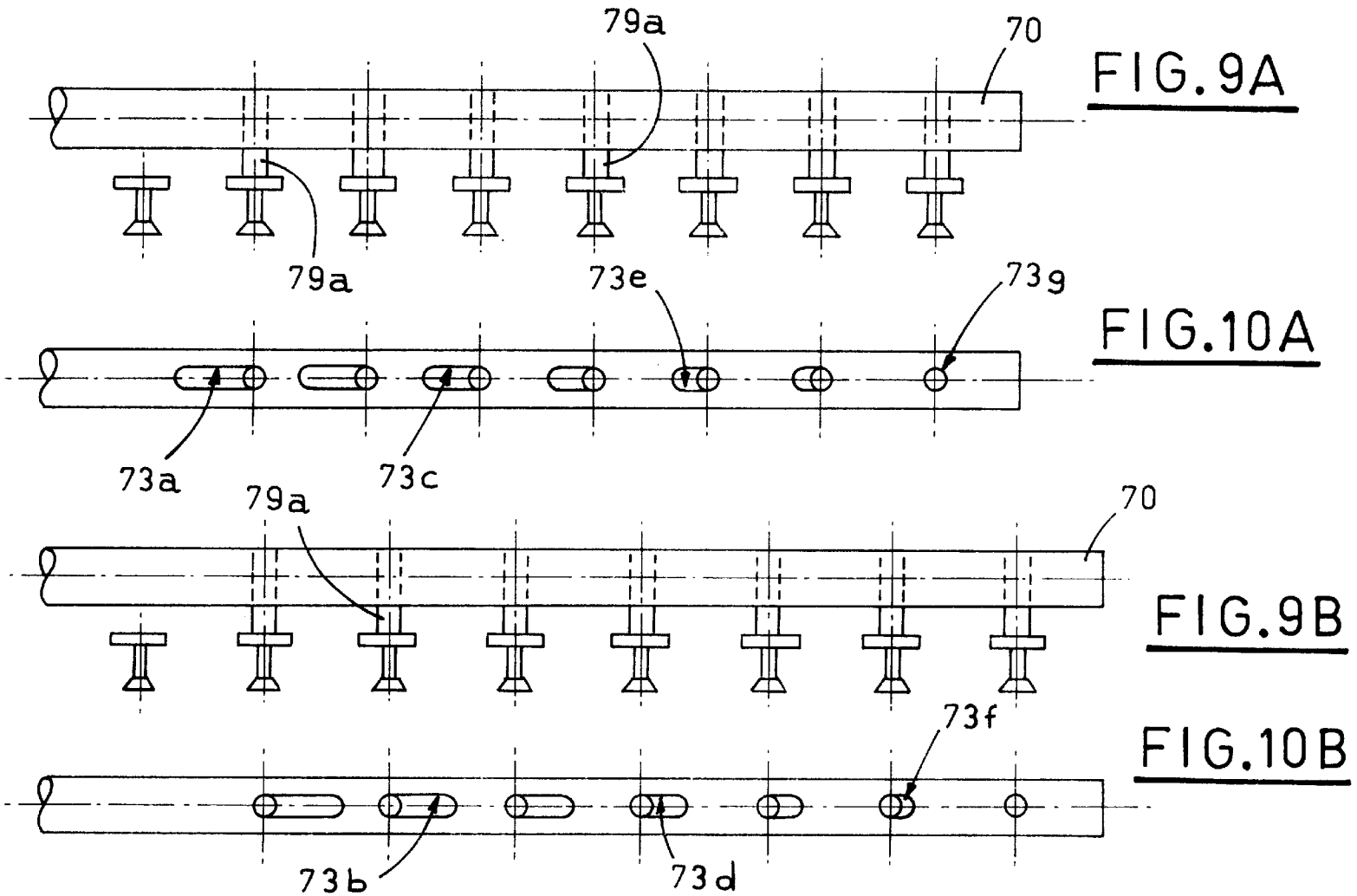
FIGS. 9*a*, 10*a* show schematic, respectively lateral and top views, of a particularly significant actuating mechanism in a first configuration.
FIGS. 9*b*, 10*b* show schematic, respectively lateral and top views, of the actuating mechanism shown in FIGS. 9*a*, 10*a*, in a second configuration.

The above mentioned control means include cam profile 71 (FIG. 8), which engages with a relative pin 72 connected to the guide shaft 70, so as to cause the latter to slide axially during the step of moving the gripping means 79; and a plurality of longitudinal slots 73*a*, 73*b*, 73*d*, 73*e*, 73*f*, 73*g* having diverse dimensions, made longitudinally in the guide shaft 70, engaging freely with control stems 79*a*, rigidly connected to the corresponding gripping means 79, so as to allow the latter to be regularly spaced apart at the release position B, due to the variation of the guide shaft 70 arrangement (FIGS. 9*a*, 10*a*).

The dimensions of the longitudinal slots 73*a*, 73*b*, 73*d*, 73*e*, 73*f*, 73*g* uniformly increase or decrease, proceeding from one side to the other of the guide shaft 70.

This way, the strip packs can be released onto the waiting line 8 uniformly spaced apart with respect to the pick up position, by a predetermined distance.

The different longitudinal extension of the slots impose different strokes to the control stems 79*a* of adjacent gripping means 79; in particular, impose longitudinal strokes which gradually increase or decrease proceeding from one side to the other of the guide shaft 70 (FIGS. 9*b*, 10*b*).

Each of the gripping means 79 is supported, in known way, by the guide shaft 70 which meshes with e.g. a corresponding driving shaft 79*b*, so as to obtain a "counter-rotation" of the one with respect to the other (FIG. 5).

Figure 7:
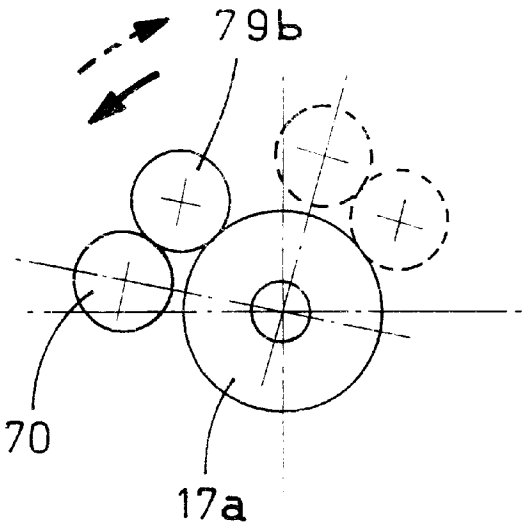
FIG. 7 shows a schematic view of extreme positions of some means of the mechanism shown in FIG. 5.

Advantageously, the driving shaft 79*b* in turn, meshes with a stationary wheel 17*a*, which extends substantially parallel thereto, following its profile during the step of moving the gripping means 79 from the pick up configurations A to the release ones B (FIG. 7).

The proposed machine for obtaining strip packs, with respect to the prior art, allows to release these packs in a controlled configuration, in particular into respective seats 9*a*, made in the conveyor means 9 situated below the waiting line 8.

This allows to feed directly a packaging machine without interposing any another kind of machine.

The reduced vertical extension of the machine, substantially obtained by two separate sections of the machine, set side by side, allows any operator to see directly the machine critical areas, in particular the products inlet area near and upstream of the upper counter-rotating rolls, as well as the continuous band of the heat-welded pockets along an extended part of the compensation magazine.

The possibility to work stepwise, or intermittently, downstream of the packaging group allows to use working means, whose construction is simpler and stronger in the region corresponding to the operating station, where the printing, code application, transversal pre-cutting and longitudinal and transversal cutting operations are performed.

Consequently, the maintenance operations of these means can be particularly streamlined and rapid, thus increasing the reliability thereof and reducing the probability of breakdown with respect to known machines.

The connection of the first machine section, operating in a continuous mode, with the second machine section, working in an intermittent operation mode, obtained by a compensation magazine, allows to change the configuration of the continuous band at the inlet of the operating station, so as to feed strip packs, to the conveyor means, in configurations arranged angularly with respect to the packaging group, in particular with in-line machine configuration and at −90° machine configuration.

It is understood that what above, has been described as a pure, not limitative example, therefore, possible variants of the invention remain within the protective scope of the present technical solution, as described above and claimed hereinafter.

What is claimed is:

1. A machine for producing so-called strip packs, the machine including:

a station for feeding products to a packaging group, situated in cascade, said packaging group comprising counter rotating rolls to place and seal each of said products in relative heat-welded pockets, arranged on a continuous band forming corresponding longitudinal and transversal rows of said pockets in a continuous non-stepwise operation;

an operating station, situated in cascade with respect to said packaging group, aimed at supplying, at the outlet, a plurality of strip packs of predetermined longitudinal and transversal dimensions, said operating station being equipped with: means for printing and/or applying codified data and/or information on each pocket of said continuous band;

feeling detecting means for verifying the presence of corresponding products inside each pocket of said continuous band;

pre-cutting groups for transversal precutting of said continuous band in portions included between adjacent transversal files;

cutting groups, a first cutting group and a second cutting group, respectively for longitudinal and transversal cutting of said continuous band in portions included between adjacent longitudinal and transversal rows; means for pulling the continuous band;

a compensation magazine interposed between said packaging group and said operating station, for accumulating, at least partially and upstream of said operating station, said continuous band, so as to allows a variable configuration thereof;

meaning for moving said continuous band stepwise and in step relation with the intermittent and synchronous operating of said, printing means and pulling means, said feeling detecting means, said pre-cutting groups and first cutting group and second cutting group, working in said operating station downstream of said packaging group.

2. A machine according to claim 1, further including a first machine section, having substantially vertical extension, with situated therein at least said feeding station and said packaging group, and a second machine section, having likewise substantially vertical extension, where at least said operating station is situated.

3. A machine according to claim 2, wherein said machine sections, first and second, are situated substantially one beside the other.

4. A machine according to claim 2, wherein said compensation magazine is situated in said second machine section.

5. A machine according to claim 1, further including transferring means, situated in cascade after said operating station and operated in step relation therewith, said transferring means being aimed at picking up strip packs at the outlet of said operating station, in substantially vertical configurations, and at releasing them onto a waiting line in substantially horizontal configurations; with said waiting line being aimed at releasing, in a differentiated way, said strip packs in predetermined configurations into corresponding seats made in conveying means, which extend substantially parallel and close to said waiting line, in step relation with the moving of the conveying means in order to allow a packaging machine to be fed.

6. A machine according to claim 5, wherein said conveying means are arranged angularly with respect to the above mentioned packaging group.

7. A machine according to claim 6, wherein said conveying means are arranged longitudinally or crosswise with respect to the above mentioned packaging group.

8. Machine, according to claim 2, further including transferring means, situated in cascade after said operating station and operated in step relation therewith, said transferring means being aimed at picking up strip packs at the outlet of said operating station, in substantially vertical configurations, and at releasing them onto a waiting line in substantially horizontal configurations; with said waiting line being aimed at releasing, in a differentiated way, said strip packs in predetermined configurations into corresponding seats made in conveying means, which extend substantially parallel and close to said waiting line, in step relation with the moving of the conveying means in order to allow a packaging machine to be fed, said transferring means being situated in said second machine section.

9. A machine according to claim 2, wherein said feeding station and said packaging group are operated synchronously with each other and continuously.

10. A machine according to claim 8, wherein that said transferring means include:

gripping means, operated by a control shaft, which slides axially, substantially parallel to said waiting line, said gripping means being moved, in step relation with said operating station, from a picking up position, in which they pick up strip packs in substantially vertical configurations at the outlet of said operating station, to a release position, in which they release said strip packs, in substantially horizontal configurations and regularly spaced apart with respect to said picking up position by a predetermined distance, onto said waiting line;

and control means, connected to said gripping means, aimed at allowing said strip packs to be released in said release position regularly spaced apart with respect to said picking up position by a predetermined value.

11. A machine according to claim 10, wherein said control means include at least one cam profile, which engages with a relative pin connected to the control shaft, so as to make the latter slide axially during the moving step of the gripping means; and a plurality of longitudinal slots having diverse dimensions, made in said control shaft and engaging freely with control stems, rigidly connected to the corresponding gripping means, so as to allow the latter to be regularly spaced apart at the release position.

12. A machine according to claim 11, wherein said longitudinal slots uniformly increase or decrease, proceeding from one side to the other of the control shaft.

13. A machine according to claim 1, wherein said packaging group includes at least one pair of upper counter-rotating rolls, situated in cascade after said feeding station, which have horizontal and parallel axes, touch each other along a common generatrix, and whose outer surfaces form, at least on a central portion, a plurality of radial recesses, which face, during synchronous movement of each roll, the radial seats of the adjacent roll, in order to define corresponding cavities, which receive the products released by said feeding station; with the outer surface of each roll being heated, in nominal functioning conditions, by at least one group of principal heating resistors, whose temperature is taken by a principal thermal probe, situated near said outer surface.

14. A machine according to claim 1, further including:

transferring means, situated in cascade after said operating station and operated in step relation therewith, said transferring means being aimed at picking up strip packs at the outlet of said operating station, in substantially vertical configurations, and at releasing them onto a waiting line in substantially horizontal configurations;

with said waiting line being aimed at releasing, in a differentiated way, said strip packs in predetermined configurations into corresponding seats made in conveying means, which extend substantially parallel and close to said waiting line, in step relation with the moving of the conveying means in order to allow a packaging machine to be fed;

with the packaging group including at least one pair of upper counter-rotating rolls, situated in cascade to said feeding station, which have horizontal and parallel axes, touch each other along a common generatrix, and whose outer surfaces form, at least on a central portion;

a plurality of radial recesses, which face, during synchronous movement of each roll, the radial seats of the adjacent roll, in order to define corresponding cavities, which receive the products released by said feeding station; with the outer surface of each roll being heated, in nominal functioning conditions, by at least one group of principal heating resistors, whose temperature is taken by a principal thermal probe, situated near said outer surface.

15. A machine according to claim 14, further including, for each upper roll, a group of additional heating resistors and an additional thermal probe, the latter situated near said outer surface, to be activated in case of breakdown of the group of principal heating resistors or of said principal thermal probe.

16. A machine according to claim 15, wherein each upper roll includes, in regions corresponding to its extremities, a respective pair of rings, whose outer surface is smooth and whose diameters are bigger than the diameter of the central portion, in which said recesses are made, said rings being aimed at ensuring a localized contact between said pair of upper rolls in the regions corresponding to the said rings.

17. A machine according to claim 16, further including at least one load cell, interposed between the two upper counter-rotating rolls, to signal possible anomalous displacements between the two upper rolls with respect to a predetermined reference value.

18. A machine according to claim 17, further including a pair of load cells, interposed between the two upper counter-rotating rolls.

* * * * *